United States Patent [19]

Midorikawa et al.

[11] Patent Number: 4,912,512

[45] Date of Patent: Mar. 27, 1990

[54] ELECTROPHOTOGRAPHIC COPIER WITH A CAPABILITY OF AUTOMATICALLY SETTING UP OPTIMUM PROCESS CONDITIONS

[75] Inventors: Akira Midorikawa, Yokohama; Yoshihiro Nakashima; Hirobumi Yoshino, both of Tokyo, all of Japan

[73] Assignee: Ricoh Company, Ltd., Tokyo, Japan

[21] Appl. No.: 317,975

[22] Filed: Mar. 2, 1989

[30] Foreign Application Priority Data

Mar. 14, 1988 [JP] Japan ..... 63-58452

[51] Int. Cl.[4] ..... G03G 15/06

[52] U.S. Cl. ..... 355/260; 355/214; 355/251

[58] Field of Search ..... 355/260, 251, 214, 203, 355/209, 211

[56] References Cited

U.S. PATENT DOCUMENTS

| | | | |
|---|---|---|---|
| 4,666,290 | 5/1987 | Yoshiura | 355/245 X |
| 4,692,018 | 9/1987 | Tamura | 355/260 |
| 4,708,455 | 11/1987 | Kubota et al. | 355/260 X |
| 4,739,367 | 4/1988 | Watanabe et al. | 355/260 X |
| 4,803,521 | 2/1989 | Honda | 355/245 X |

*Primary Examiner*—A. C. Prescott

*Attorney, Agent, or Firm*—Oblon, Spivak, McClelland, Maier & Neustadt

[57] ABSTRACT

An electrophotographic copier selectively operable with various kinds of toner automatically sets up optimum copy process conditions for any particular characteristic of toner to be used when a toner cartridge is replaced. The copy process conditions are changed upon the lapse of a predetermined delay time after the replacement of a toner cartridge. When an old toner cartridge mounted on the copier is replaced with a new toner cartridge which stores toner of a kind that should not be mixed with toner stored in the former, the copier identifies the new toner cartridge and produces an alarm to inhibit the replacement.

3 Claims, 7 Drawing Sheets

ELECTROPHOTOGRAPHIC COPIER WITH A CAPABILITY OF AUTOMATICALLY SETTING UP OPTIMUM PROCESS CONDITIONS

BACKGROUND OF THE INVENTION

The present invention relates to an image recorder selectively operable with a plurality of toner cartridges each storing toner, or developer, having a different characteristic. More particularly, the present invention is concerned with an electrophotographic copier capable of automatically setting up optimum copy process conditions in association with the characteristic of toner to be used.

Generally, an electrophotographic copier is designed to meet a particular requirement depending upon the application, e.g. compact configuration, high-speed operation, cut-down of cost or that of power consumption. It is a common practice to implement such a particular requirement by a particular kind of copying process. Concerning a developing process, two different processes are available: a process using a one-component developer which is constituted by toner only and a process using a two-component developer made up of toner and carrier. These developing processes are also selectively adopted to satisfy any of the above requirements. For example, toner applicable to the developing process which uses a two-component developer include lusterless toner, low melting point toner, oilless toner and other special toners, and each is used with a particular copying process. The lusterless toner, for example, consists of carbon and styrol or similar resin the mixture ratio and particle sizes of which are variable to make the surface of toner appear irregular after fixation (so-called aventurine), as well known in the art. The low melting point toner is produced by replacing the whole or part of the resin to be mixed with carbon with resin having a low melting point and adopted for an application wherein power saving is the primary consideration. Further, the oilless toner is implemented by resin which is the mixture of styrol resin and polypropyrene resin or the like and eliminates the need for silicon oil or similar composition which is usually applied to a fixing roller to facilitate the separation of a paper sheet from the fixing roller.

Copy process conditions for achieving desirable copies depend upon the characteristic of toner to be used. Customarily, once a particular kind of toner is selected in relation to a desired application, copy process conditions which match with the kind of toner are fixedly set up and, therefore, a single copier is not selectively operable with different kinds of toner. Hence, a copier once purchased cannot adapt itself to a different object and condition of use which may be desired afterwards, unless the copier is replaced with another type of copier. While various efforts have heretofore been made to render a single copier operable with toner of different colors and different characteristics, all of them require a developing unit or a process cartridge which includes a discharger and a developing unit to be replaced with another depending upon the kind of toner used. It is therefore necessary to furnish a single copier with different kinds of replaceable developing units or process cartridges. This not only increases the burden cast upon the user but also makes the storage and disposal of the process cartrdiges troublesome.

Furthermore, a prior condition with a conventional toner cartridge is that the same kind of toner be supplied and not that the kind of supplied toner be detected to select and change the copy process conditions in association therewith. Various kinds of toner have recently been developed which may be used in a mixture each by a small amount despite their different characteristics, i.e., which may be mixed in a transitional stage which occurs after toner replacement. In any case, however, optimum process conditions which match with the individual toner are different from each other. With the prior art copier, therefore, when a toner cartridge storing a certain kind of toner is simply replaced with toner cartridge storing a different kind of toner, copying operations cannot be performed except under the same process conditions as the previous toner.

SUMMARY OF THE INVENTION

It is therefore an object of the present invention to eliminate the drawbacks particular to the prior art as discussed above.

It is another object of the present invention to provide an electrophotographic copier capable of automatically setting up optimum copy process conditions which match with the characteristic of toner to be used when a toner cartridge is replaced.

It is another object of the present invention to provide a generally improved electrophotographic copier selectively operable with a plurality of toner cartridges each storing a different kind of toner.

An image recorder using a toner cartridge which is provided with identification information for identifying the toner cartridge in distinction from other toner cartridges with respect to a characteristic of toner stored in the toner cartridge of the present invention comprises a sensor for sensing the identification information when the toner cartridge is mounted on the image recorder, and a control for controlling, in response to a sense output of the sensor, copy process conditions in dependence upon the characteristic of toner.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

An image recorder embodying the present invention will be described in detail with reference to the accompanying drawings. The following description will proceed on the assumption that the image recorder is an electrophotographic copier and that the copier is selectively operable with two different kinds of toner, i.e., ordinary toner and a special kind toner, to facilitate an understanding of the present invention. Nevertheless, the present invention is of course applicable to any other type of electrophotographic copier or similar image recorder with which three or more kinds of toner are usable. The special kind of toner is different from ordinary toner with respect to charging characteristic due to friction with carrier which is implemented by iron powder or similar material, fixing characteristic on a paper sheet, etc. Hence, various copy process conditions such as charge potential, bias voltage for development, current for image transfer, current for paper separation, fixing temperature and nipping pressure acting between a fixing and a pressing roller have to be varied depending upon the kind of toner. Among such process conditions, the bias voltage for development and the fixing temperature will be discussed in the following paragraphs by way of example.

Figure 1:
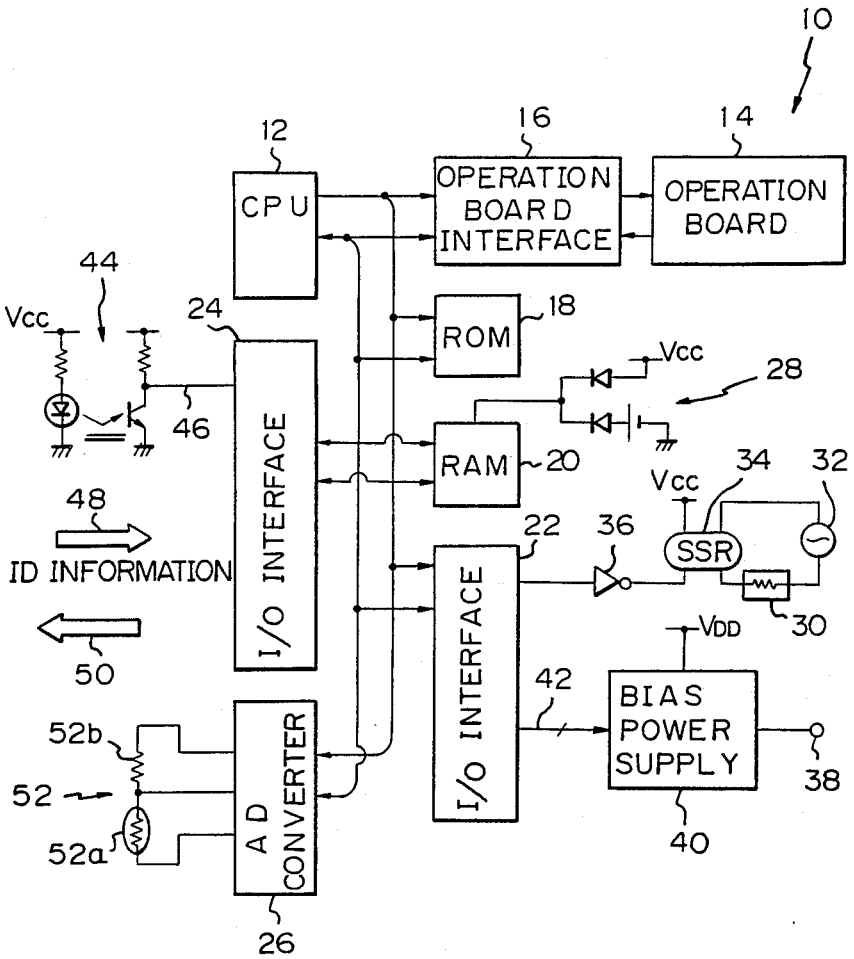
FIG. 1 is a schematic block diagram of a control circuit which is included in an image recorder in the form of an electrophotographic copier embodying the present invention.

Referring to FIG. 1 of the drawings, there is shown a control circuit which is installed in an elctrophotographic copier embodying the present invention. The control circuit, generally 10, includes, for example, an eight-bit microcomputer (CPU) 12 for governing the entire control circuit, an operation board 14, and an operation board interface 16. The control circuit 10 further includes a ROM 18 which stores control programs and permanent data as will be described, a RAM 20 accessible for reading and writing various flags and copy data, input/output (I/O) interfaces 22 and 24 for interfacing various input/output units, and an analog-to-digital (AD) converter 26. The RAM 20 is backed up by a back-up circuit 28 which includes a battery.

A heating element or heater 30 is connected to a heater power supply 32 and heats a fixing roller, not shown, under the control of an SSR 34. The SSR 34 is driven by a driver 36. A control fixing temperature is fed from the I/O interface 22 to the driver 36. A bias power supply 40 applies a control bias voltage for development to a developing sleeve 38 in response to a signal which is fed from the I/O interface 22 over four signal lines 42.

A cartridge sensor 44 is connected to the I/O interface 24 by a signal line 46 for sensing identification (ID) information provided on a toner cartridge and representative of the kind of toner stored in the cartridge. Also connected to the I/O interface 24 are an input line 48 and an output line 50 as schematically indicated by arrows. In the illustrative embodiment, the cartridge sensor 44 is implemented as a reflection type photointerrupter having a light emitting and a light-sensitive element. Alternatively, any other type of optical sensor or even a magnetic sensor, a switch type sensor or an electrical resistance type sensor may be used in matching relation to the kind of ID information, and an arrangement may be so made as to output multi-level data if necessary. Connected to the AD conerter 26 is a temperature sensing circuit 52 which is made up of a thermistor **52*a* and a voltage dividing resistor 52*b*. The thermistor 52*a* senses surface temperatures of the fixing roller, while the resistor 52*b* converts changes of resistance of the thermistor 52*a*** into voltages.

Figure 2:
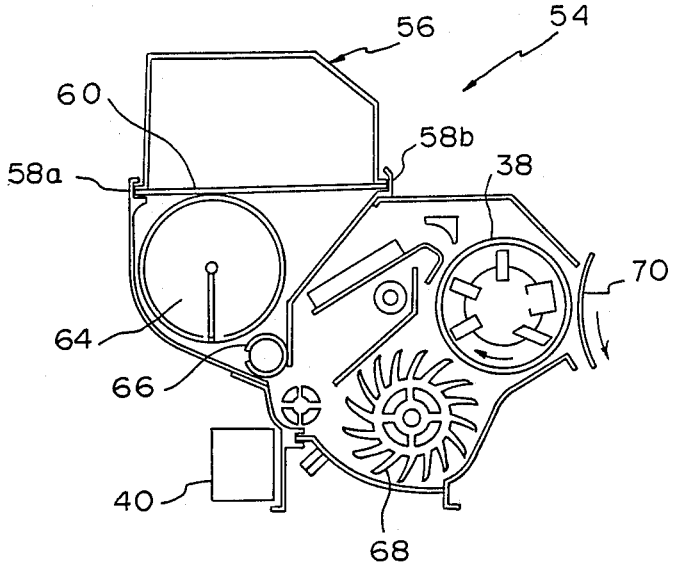
FIG. 2 is a section showing a developing unit of the copier of FIG. 1.
Figure 3:
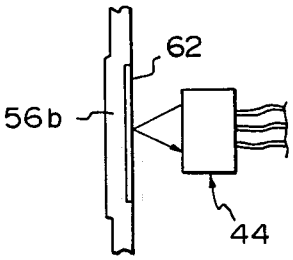
FIG. 3 is a fragmentary enlarged view showing the relationship between a cartridge sensor and identification information.
Figure 4:
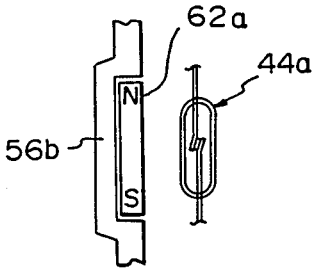
FIG. 4 is view similar to FIG. 3, showing an alternative relationship between a cartidge sensor and identification information.

FIG. 2 shows a developing unit 54 which is included in the illustrative embodiment of the coier in accordance with the present invention. As shown, a toner cartridge 56 packed with toner is removably mounted on the developing unit 54. More specifically, the toner cartridge 56 is slid into the developing unit 54 toward the back of the sheet of FIG. 2 with lugs provided at its opposite lower sides being engaged with and guided by guide portions **58*a* and 58*b* of the unit 54. After the toner cartridge 56 has been so mounted, a bottom plate 60 of the cartridge 56 is pulled out toward the sheet surface of FIG. 2 so that the toner in the cartridge 56 is let fall into the developing unit 54. ID information representative of a characteristic, or kind, of the toner stored in the toner cartridge 56 is provided on a suitable part of the cartridge 56. Before the bottom plate 60 of the toner cartridge 56 mounted on the developing unit 54 is pulled out, the cartridge sensor 44 senses the ID information. Since this embodiment is assumed to use one ordinary kind of toner and one special kind of toner as stated earlier, a cartridge 56*a* loaded with ordinary toner and a cartridge 56*b* loaded with special toner may be distinguished by providing the former with no mark and providing the latter with, for example, a reflective seal 62 as shown in FIG. 3. As shown in FIG. 4, when use is made of a cartridge sensor 44*a* which is implemented by a reed switch, a miniature permanent magnet 62*a* may be buried in a particular part of the cartridge 56*b*** which is to be sensed to provide the ID information.

In FIG. 2, a toner hopper 64 temporarily stores the toner which is fed from the toner cartridge 56. The toner from the toner hopper 64 is driven by each predetermined amount toward the subsequent stage by a toner supply roller 66. A paddle wheel 68 mixes the toner with carrier while transporting the resulting mixture to the developing sleeve 38. Consequently, a latent image electrostatically formed on a photoconductive drum 70 is developed by the mixture of toner and carrier, i.e. developer.

Figure 5:
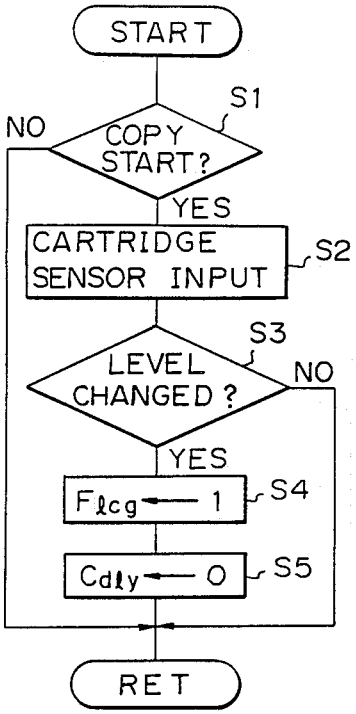
FIGS. 5 to 8 are flowcharts exemplarily demonstrating control programs.

Referring to FIGS. 5 to 8, examples of control programs which are stored in the ROM 18 are shown in flowcharts. Specifically, FIG. 5 shows a control program in which a change of input level of the cartridge sensor 44 or **44*c* is sensed at the start of a copying operation. The program of FIG. 5 begins with a step S1 of determining whether or not a copy start command has been entered. If the answer of the step S1 is YES, a level of the cartridge sensor 44 or 44*a* is inputted in a step S2. In the subsequent step S3, the inputted level of the cartridge sensor 44 or 44*a* is compared with the immediately preceding inputted level to see if the level has changed. If the level has changed, a step S3 is executed for setting a level change flag $F_{lcg}$. This is followed by a step S5** for resetting a delay counter $C_{dly}$.

Figure 6:
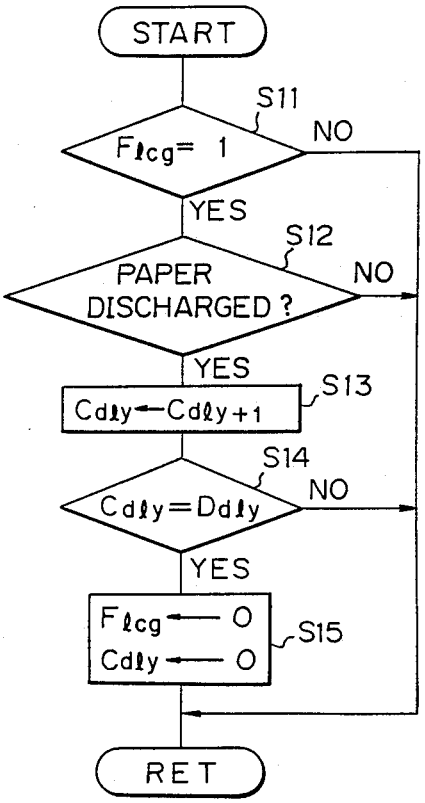

FIG. 6 shows a sequence of steps which occur when the level change flag $F_{lcg}$ is set. Specifically, when the level change flag $F_{lcg}$ is set as determined by a step S11, whether a copy has been discharged is determined by a step S12 on the basis of an output signal of a copy discharge sensor. In the following step S13, the delay counter $C_{dly}$ is incremented by one at a time every time one copy is discharged. A step S14 is executed to see if the delay counter $C_{dly}$ has reached a predetermined value $D_{dly}$. In the illustrative embodiment, the predetermined value $D_{dly}$ is associated with the number of copies produced which would replace a predetermined proportion of old toner remaining in the developing unit 54 with with new toner. If the delay counter $C_{dly}$ has reached the value $D_{dly}$ as decided by the step S14, a step S14 is executed for resetting the level change flag $F_{lcg}$ and delay counter $C_{dly}$.

Figure 7:
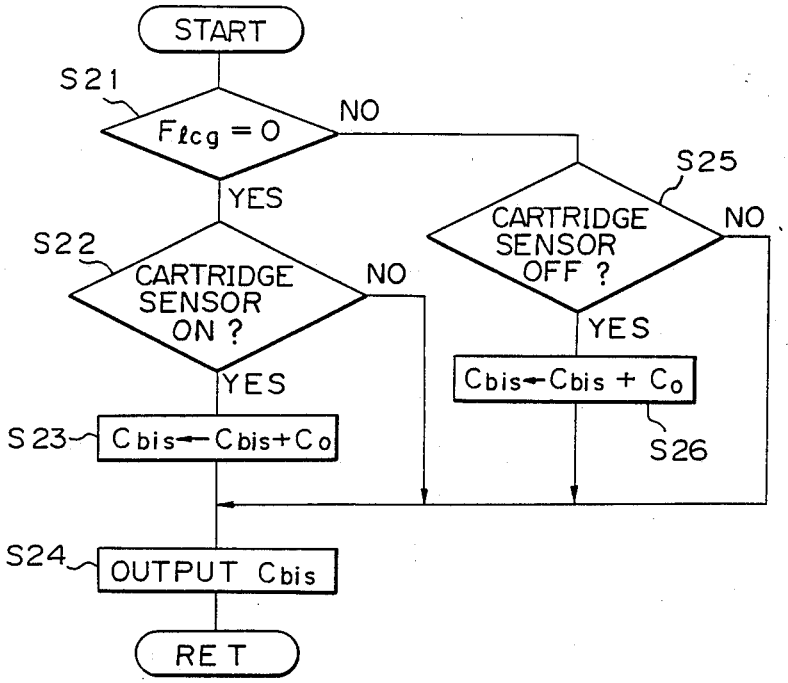

FIG. 7 shows a procedure for determining a value of a bias voltage code $C_{bis}$ which in turn determines a bias voltage for development to be fed from the bias power supply 40, on the basis of a logical level of the level change flag $F_{lcg}$ which is a ONE (set) or a ZERO (reset). It is to be noted that the bias voltage code $C_{bis}$ is associated with the four signal lines 42 of FIG. 1. The program shown in FIG. 7 begins with a step S21 of determining whether or not the flag $F_{lcg}$ is a ZERO. If the flag $F_{lcg}$ is a ZERO, whether or not the output level of the cartridge sensor is a ONE (or ON) is determined by a step S22. If the flag $F_{lcg}$ is not a ZERO, the procedure is transferred to a step S25 to see if the output level of the cartridge sensor is a ZERO (or OFF). If the answer of the step S22 is YES, a step S23 is performed to correct the bias voltage code $C_{bis}$ by $C_0$, i.e., to produce $C_{bis}+C_0$. When the answer of the step S25 is YES, the bias voltage code $C_{bis}$ is also corrected by $C_0$ in a step S26 so as to produce $C_{bis}+C_0$. In the final step S24, the resulting bias voltage code $C_{bis}$ is fed out. Assuming that the level change flag $F_{lcg}$ is reset, a particular value $C_{bis}$ determined by an independent procedure (not shown) is fed out when the cartridge sensor is in a ZERO and a value $C_{bis}+C_0$ is fed out when the cartridge sensor is in a ONE. However, when the flag $F_{lcg}$ is set, such a relationship is inverted to show that a change of bias voltage occurs with a delay which is associated with a predetermined number of copies.

Figure 8:
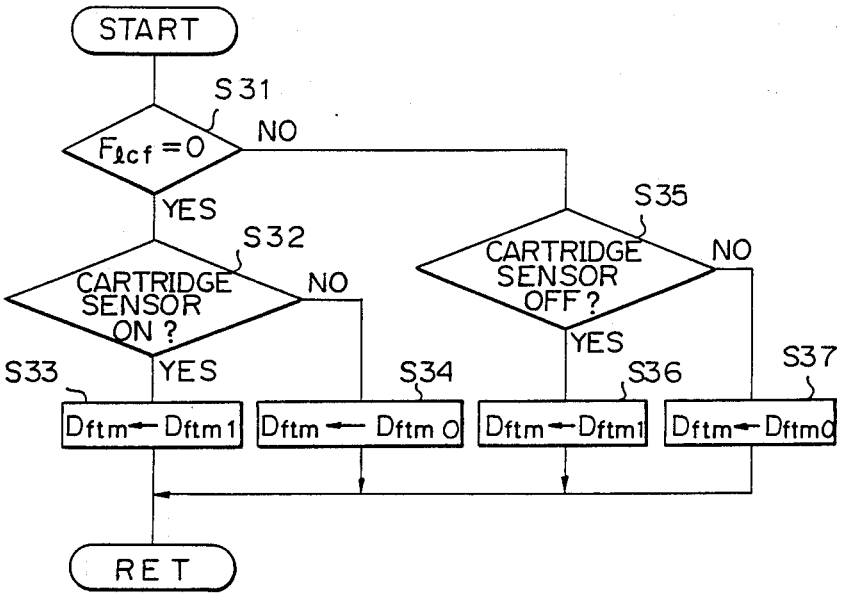

FIG. 8 shows a procedure for controlling the control temperature of the fixing roller, i.e., fixation control temperature $D_{ftm}$ on the basis of the level change flag $F_{lcg}$. First, whether or not the flag $F_{lcg}$ is a ZERO is determined in a step S31. If the answer of the step S31 is YES, a step S32 is executed. If it is NO, the program is transferred to a step S35. If the output level of the cartridge sensor is a ONE (or ON) as decided by the step S32, a step S33 is performed to change the control temperature $D_{ftm}$ to $D_{ftm1}$. If the answer of the step S32 is NO, $D_{ftm}$ is changed to $D_{ftm0}$ in a step S34. In the step S35, whether or not the output level of the cartridge sensor is a ZERO (OFF) is determined. If the answer of the step S35 is YES, a step S36 is executed for changing $D_{ftm}$ to $D_{ftm1}$; it it is NO, the operation advances to a step S37 for changing $D_{ftm}$ to $D_{ftm0}$. In such a sequence of steps, so long as the flag $F_{lcg}$ is reset, the control temperature $D_{ftm}$ has the predetermined value $D_{ftm0}$ when the output of the cartridge sensor is a ZERO and has the value $D_{ftm1}$ when it is in a ONE. However, when the flag $F_{lcg}$ is set, this relationship is inverted to show that a change of fixing temperature is delayed by a period of time associated with the predetermined number of copies.

Figure 9:
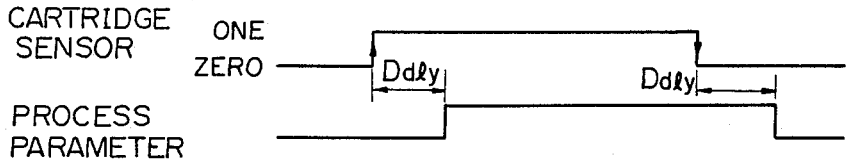
FIG. 9 is a timing chart schematically showing a delay involved in the change of process conditions.

FIG. 9 schematically shows in a timing chart how a delay of process conditions stated above occur. As shown, a process condition or parameter is delayed by a predetermined period of time (associated with the predetermined number of copies) $D_{dly}$ relative to a change of output level of the cartridge sensor. More specifically, when one kind of toner is replaced with another kind of toner, a certain amount of old toner is still left in the developing unit 54. Since collecting such old toner needs much time and labor, the illustrative embodiment is constructed and arranged to consume the old toner entirely. Therefore, immediately after the replacement of toner, toner having characteristic 1 (old toner) and toner having characteristic 2 (new toner), for example, are mixed together. Nevertheless, due to the predetermined delay $D_{dly}$, the previous process conditions matching with the previous toner is maintained before the delay $D_{dly}$ is reached, and it is replaced with new process conditions matching with new toner when the delay $D_{dly}$ expires, by way of example.

Figure 10:
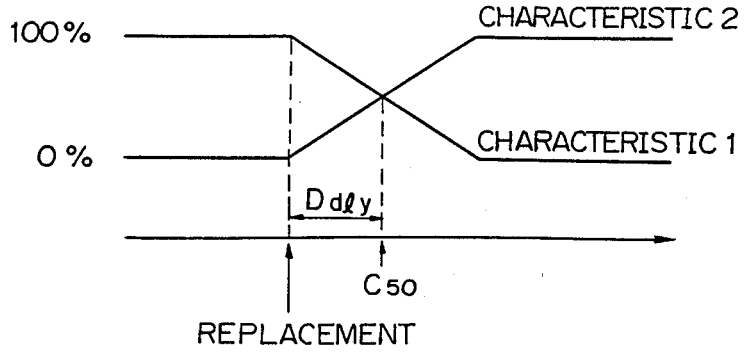
FIG. 10 is a diagram schematically showing a transitional stage which occurs after the replacement of toner.

FIG. 10 shows the varying proportion of toner having characteristic 1 and toner having characteristic 2 to each other in the mixture, with respect to the delay $D_{dly}$. As shown, the delay $D_{dly}$ extends from a time of cartridge replacement to a time $C_{50}$ when the proportion reaches 50%. It should be noted, however, that such a delay $D_{dly}$ is only illustrative and may be changed as desired depending upon the conditions of interchangeable toner.

The embodiment of the present invention has been shown and described in relation to two different kinds of toner only. It will be apparent to those skilled in the art that the embodiment is selectively operable with three or more different kinds of toner if use is made of a cartridge sensor which produces a multi-level output.

Figure 11:
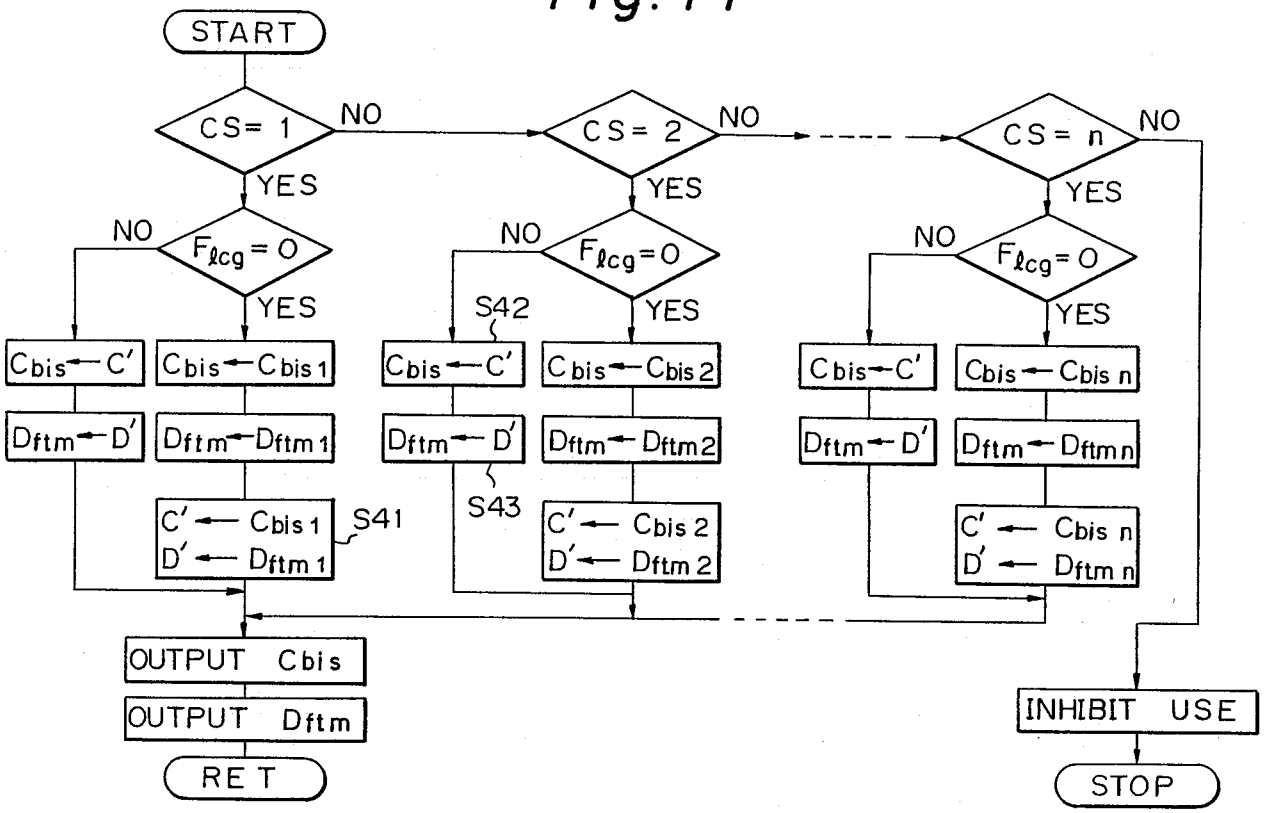
FIG. 11 is a timing chart exemplarily showing a control program in accordance with another embodiment of the present invention.

Referring to FIG. 11, a specific program for allowing n kinds of toner to be selectively used. In the figure, CS which is any of 1, 2, . . . , n is representative of an output of the cartridge sensor indicative of the kind of toner, and C' and D' are adapted to store $C_{bis}$ and $D_{ftm}$, respectively. C' and D' are used when control is effected under the toner conditions ($C_{bis}$ and $D_{ftm}$) of the previous cartridge during the previously mentioned delay time. Assuming that toner 1 is replaced with toner 2, $C_{bis1}$ and $D_{bis1}$ inputted respectively in C' and D' by a step S41 are inputted respectively in $C_{bis}$ and $D_{bis}$ by steps S42 and S43.

Concerning the delay $D_{dly}$, a different optimum value may be selected depending upon the change of the characteristic of toner such as from characteristic 1 to characteristic 2, from characteristic 2 to characteristic 3 or from characteristic 2 to characteristic 1, through case study. For example, assuming that ordinary toner a and oilless toner b are available and that the toner b is to be substituted for the toner a, the supply of silicon oil to the fixing roller has to be continued until the toner a almost runs out. On the other hand, when the toner a is to be substituted for the toner b, the supply of silicon oil has to be started as soon as the supply of the toner a begins. Delays $D_{dlyab}$ and $D_{dlyba}$ each having a different optimum value may be selected in matching relation to such conditions. This can be implemented by executing an additional step of "$D_{dly} \leftarrow D_{dlymn}$ (where $D_{dlymn}$ is the number of copies associated with a delay in the event of a change from toner having characteristic m to toner having characteristic n)" after the answer of the step S3 has been determined to be YES.

There are some kinds of toner which have to be prevented from being mixed together, e.g. toner of different colors. In the illustrative embodiment, when such a kind of toner is identified, an alarm is produced before the user or operator pulls out the bottom plate 60 of the new cartridge 56 out of the developing unit 54. This can be done by adding a routine in which the kind of toner "$CS_{old}$" stored in the old toner cartridge is memorized and, when the kind of toner "$CS_{new}$" stored in the new toner cartridge is determined by sensing ID information on the latter, $CS_{old}$ and $CS_{new}$ are compared to see if the change from the old toner to the new toner is allowable.

Such a routine may follow "START" of the flowchart shown in FIG. 11, for example. It is of course necessary to memorize beforehand whether or not combination is allowable with respect to all kinds of toner which are usable with the copier. When mixing old and new toner is not allowable, a display and/or a sounder provided on the operation board 14 is caused to produce an alarm to inhibit the operator from replacing the old cartridge with the new cartridge.

Although a toner cartridge cannot be replaced without opening a cover of the copier, this does not effect the alerting operation at all because a DC power supply associated with the control system remains active. Since the display on the operation board 14 is sometimes difficult to see, it is preferable to energize a buzzer or similar sounder together with the display.

It should be born in mind that the various control programs, the kind of ID information, how to sense the ID information, and the like discussed above are only illustrative and may of course be changed or modified within the scope of the present invention.

In summary, it will be seen that the present invention provides a copier which are selectively operable with different kinds of toner and, when a toner cartridge is replaced, automatically sets up optimum copy process conditions that match with the characteristic of toner to be used next. A change in any process condition is delayed by a predetermined period of time so as to reduce the non-coincidence of copy process conditions in a transitional stage which follows toner replacement. Further, when new toner which should not be mixed with old toner is identified, an alarm is produced to inhibit a person from substituting the former for the latter.

Various modifications will become possible for those skilled in the art after receiving the teachings of the present disclosure without departing from the scope thereof.

What is claimed is:

1. An image recorder using a toner cartridge which is provided with identification information for identifying said toner cartridge in distinction from other toner cartridges with respect to a characteristic of toner stored in said toner cartridge, comprising:

sensing means for sensing the identification information when said toner cartridge is mounted on said image recorder; and control means for controlling, in response to a sense output of said sensing means, copy process conditions in dependence upon the characteristic of toner.

2. An image recorder as claimed in claim 1, wherein when toner having one characteristic is replaced with toner having another characteristic, said control means causes a change from old copy process conditions to new copy process conditions upon lapse of a predetermined delay time which is associated with a predetermined number of copies produced.

3. An image recorder as claimed in claim 1, wherein when toner stored in a toner cartridge which is newly mounted on said image recorder is of a kind which should not be mixed with previously supplied toner, said control means produces an alarm.

* * * * *